US007901548B2

(12) United States Patent
Beckmann et al.

(10) Patent No.: US 7,901,548 B2
(45) Date of Patent: Mar. 8, 2011

(54) ELECTROLYSIS CELL WITH ENLARGED ACTIVE MEMBRANE SURFACE

(75) Inventors: Roland Beckmann, Lünen (DE); Karl Heinz Dulle, Olfen (DE); Randolf Kiefer, Bochum (DE); Peter Woltering, Neuenkirchen (DE)

(73) Assignee: Uhdenora S.p.A., Milan (IT)

( * ) Notice: Subject to any disclaimer, the term of this patent is extended or adjusted under 35 U.S.C. 154(b) by 894 days.

(21) Appl. No.: 11/795,174

(22) PCT Filed: Jan. 25, 2006

(86) PCT No.: PCT/EP2006/000643

§ 371 (c)(1),
(2), (4) Date: Jul. 11, 2007

(87) PCT Pub. No.: WO2006/079522

PCT Pub. Date: Aug. 3, 2006

(65) Prior Publication Data

US 2008/0245661 A1 Oct. 9, 2008

(30) Foreign Application Priority Data

Jan. 25, 2005 (DE) ..... 10 2005 003 527

(51) Int. Cl.
*C25B 9/08* (2006.01)
*C25B 1/46* (2006.01)

(52) U.S. Cl. ..... 204/252; 204/279; 204/297.01

(58) Field of Classification Search ..... None
See application file for complete search history.

(56) References Cited

U.S. PATENT DOCUMENTS

| | | | | |
|---|---|---|---|---|
| 4,029,565 | A * | 6/1977 | Bender et al. | 204/256 |
| 4,309,264 | A * | 1/1982 | Bender et al. | 204/256 |
| 4,381,979 | A * | 5/1983 | De Nora et al. | 205/531 |
| 4,420,387 | A * | 12/1983 | Bergner et al. | 204/263 |
| 4,639,303 | A * | 1/1987 | Staab et al. | 204/258 |
| 4,664,770 | A * | 5/1987 | Schmitt et al. | 204/252 |
| 4,698,143 | A * | 10/1987 | Morris et al. | 204/253 |
| 5,693,202 | A * | 12/1997 | Gestermann et al. | 204/265 |
| 6,165,332 | A * | 12/2000 | Gestermann et al. | 204/258 |
| 6,282,774 | B1 * | 9/2001 | Borucinski et al. | 29/592.1 |
| 6,495,006 | B1 * | 12/2002 | Kimura et al. | 204/254 |
| 6,503,377 | B1 * | 1/2003 | Borucinski et al. | 204/257 |
| 6,984,296 | B1 * | 1/2006 | Gestermann | 204/252 |
| 7,363,110 | B2 * | 4/2008 | Revill et al. | 204/257 |

* cited by examiner

*Primary Examiner* — Harry D Wilkins, III
(74) *Attorney, Agent, or Firm* — Charles A. Muserlian

(57) ABSTRACT

The invention relates to an electrolytic cell for the production of chlorine from an aqueous alkali halide solution, which mainly consists of two semi-shells, an anode, a cathode and an ion exchange membrane arranged between the electrodes. Spacer elements are arranged between the ion-exchange membrane and the electrodes for fixing the membrane in position and distributing the compressive forces, made of electrically conductive and corrosion-resistant material on at least one side of the membrane.

11 Claims, 4 Drawing Sheets

ELECTROLYSIS CELL WITH ENLARGED ACTIVE MEMBRANE SURFACE

Figure 1:
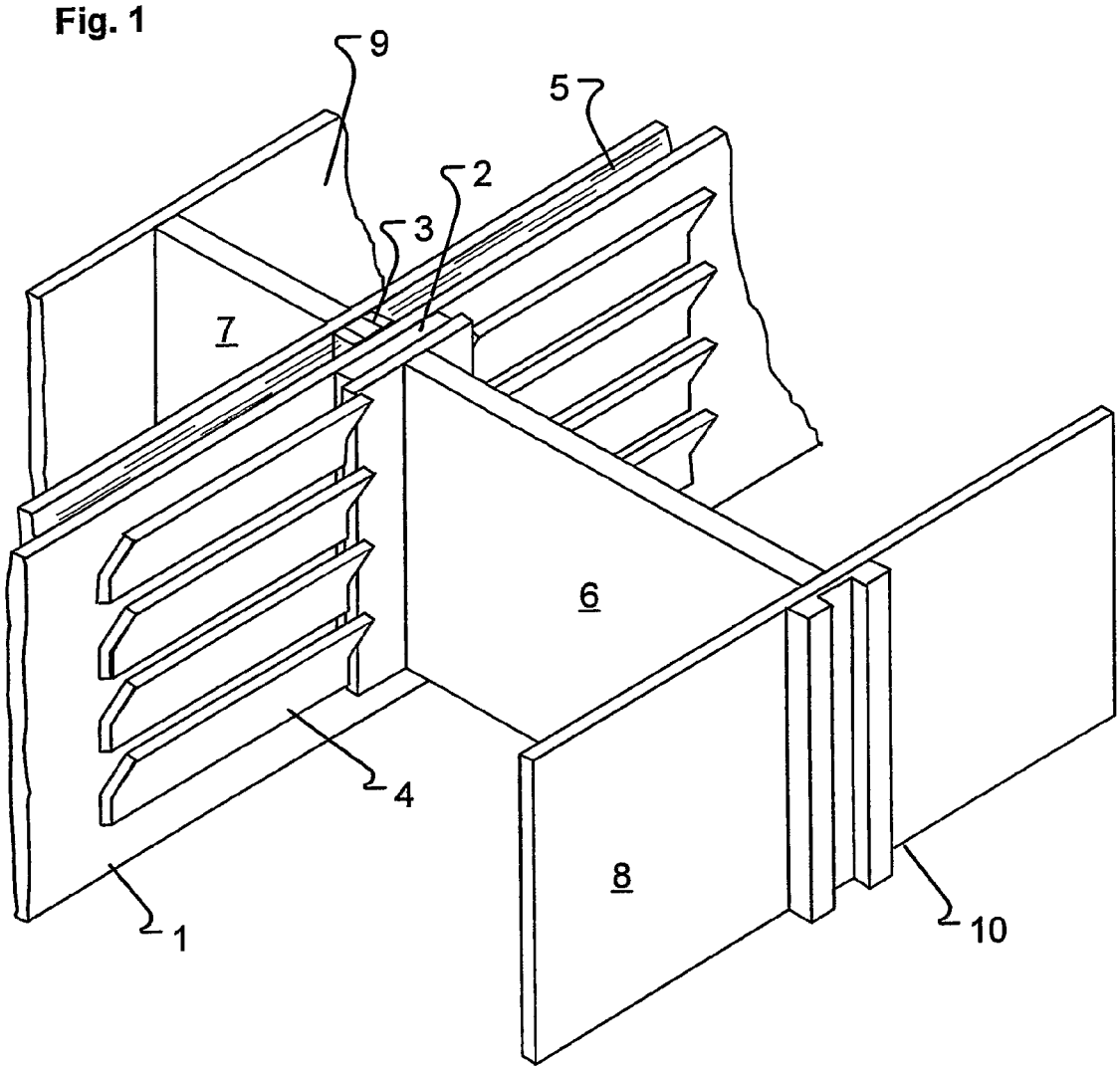

This application is a 371 of PCT/EP2006/000643 filed Jan. 25, 2006.

The invention relates to an electrolytic cell for the production of chlorine from an aqueous alkali halide solution, said cell mainly consisting of two semi-shells, an anode, an cathode and an ion-exchange membrane (hereinafter referred to as "membrane"). The internal side of each semi-shell is equipped with strips made of conductive material, which support the respective electrode and which transfer the clamping forces acting from the external side and spacer elements arranged between the ion-exchange membrane and the electrodes for fixing the membrane in position and distributing the mechanical forces. The spacers are placed on at least one side of the ion exchange membrane and are made of electrically conductive and corrosion-resistant material.

Electrolytic devices of the single-cell type for the production of halogen gases are known in the art. In the single-cell type construction up to 40 individual cells are suspended in parallel on a rack and the respective walls of adjacent pairs of cells are electrically connected to each other, for example by means of suitable contact strips. In this way the ion-exchange membrane is subjected to high mechanical loads originated by the externally applied clamping force, which must be transferred through this element.

It is known in the present state of technology to weld the electrodes to the respective semi-shells on strips placed perpendicularly to the electrode and the semi-shell rear wall, and hence aligned in the direction of the clamping force. A multiplicity of spacers are positioned in the space between the membrane and the electrodes so that the membrane subject to the external mechanical forces is clamped by said spacers and thus fixed in position. The spacers are arranged in opposite pairs defining a contact area, and the strips are positioned on the opposite side of the electrode in correspondence of said contact area.

Electrolytic cells of this type are disclosed in DE 196 41 125 and EP 0 189 535. As described in DE 25 38 414, the spacer elements are made of electrically insulating material. EP 1 073 780 and EP 0 189 535 also teach that the spacers do not consist of metallic and electrically conductive components. This derives from the fact that the opposite spacer pairs bring about a reduction of the membrane thickness in the relevant contact area. If the spacer elements were made of electrically conductive material, short-circuits could be originated in the membrane under the effect of the mechanical load and of the reduced membrane thickness.

The membrane areas shielded by the spacer elements become inactive under the point of view of current transmission. During the cell assembly it is virtually impossible to ensure that a perfect matching of the spacer pairs is effectively achieved. The resulting membrane surface is therefore somewhat larger than the theoretical surface specified in compliance with the constructive design.

It is one of the objects of the present invention to provide an electrolytic cell design overcoming the above illustrated deficiency, in particular allowing for a better use of the membrane active surface area.

The object set forth above as well as further and other objects and advantages of the present invention are achieved by providing an electrolytic cell for the production of chlorine from an aqueous alkali halide solution, which comprises two semi-shells, and two electrodes, an anode and a cathode, with an ion-exchange membrane arranged therebetween. The internal side of each semi-shell is equipped with elongated electrically conductive devices which support the respective electrode and transfer the clamping forces acting from the external side. Moreover, spacer elements are arranged between the ion-exchange membrane and the electrodes in order to fix the membrane in position and distribute the mechanical forces, wherein on just one side of the ion-exchange membrane said spacer elements are made of electrically conductive and corrosion-resistant material.

In a preferred embodiment of the invention the spacer elements on the side of the electric current admission, corresponding to the anode side of the membrane, are made of electrically conductive and corrosion-resistant material whereas the spacer elements made from electrically insulating material are installed on the cathode side.

In a particularly preferred embodiment the diameter of the spacer element surfaces in contact with the membrane and consisting of electrically insulating material is lower than 6 mm, more preferably lower than 5 mm. The inventors have surprisingly observed that the use of spacer elements with a diameter below 6 mm or less does not affect at all the current transmission properties of the membrane.

As mentioned above, with the cells of the prior art it was very difficult to ensure a perfect matching of the opposed spacer element pairs during the cell assembly; the present invention offers a substantial facilitation in this regard since it is possible to couple a first narrow spacer opposite a second slightly wider spacer, the latter being the one made of conductive material and therefore not liable to inactivate the corresponding membrane area. Alternatively, it is also possible to use wide spacer elements with a suitably open structure, provided that the diameter of the opposed surfaces effectively in contact remains well below 6 mm. In this way the assembly of the cells is substantially simplified.

A further enhancement can be obtained by suitably shaping the electrode in the strip contact area so as to form an integral spacer element on the membrane side, allowing to avoid the use of a separate spacer element.

According to a preferred embodiment of the invention, the electrically conductive and corrosion-resistant material used for the spacer components of the electrolytic cells of the invention is selected from the group of titanium and alloys thereof, nickel and alloys thereof, titanium-coated and nickel-coated materials.

In another preferred embodiment of the invention, the membrane thickness is increased by at least 10% in correspondence of the contact area with the electrically conductive spacer elements, said increase in thickness being obtained by applying an additional coating on one side of the membrane, preferably the cathode side. This membrane reinforcement permits a local compensation of the mechanical load imparted by the small cross-sectional area of the spacer element without having to increase the resistance of the whole membrane.

In an alternative embodiment of the invention, both the opposed spacer elements are metallic and electrically conductive and the membrane thickness is increased by at least 10% in correspondence of the contact area therewith. The increase in thickness of the ion-exchange membrane preferably does not exceed the double of the original membrane thickness.

According to another embodiment of the invention, the membrane thickness is uniform throughout the whole surface, metallic and electrically conductive spacer elements are installed on both sides, said spacers being coated with a material having substantially the same or equivalent properties with respect to the ion-exchange membrane in correspondence of the contact area.

Figure 2A:
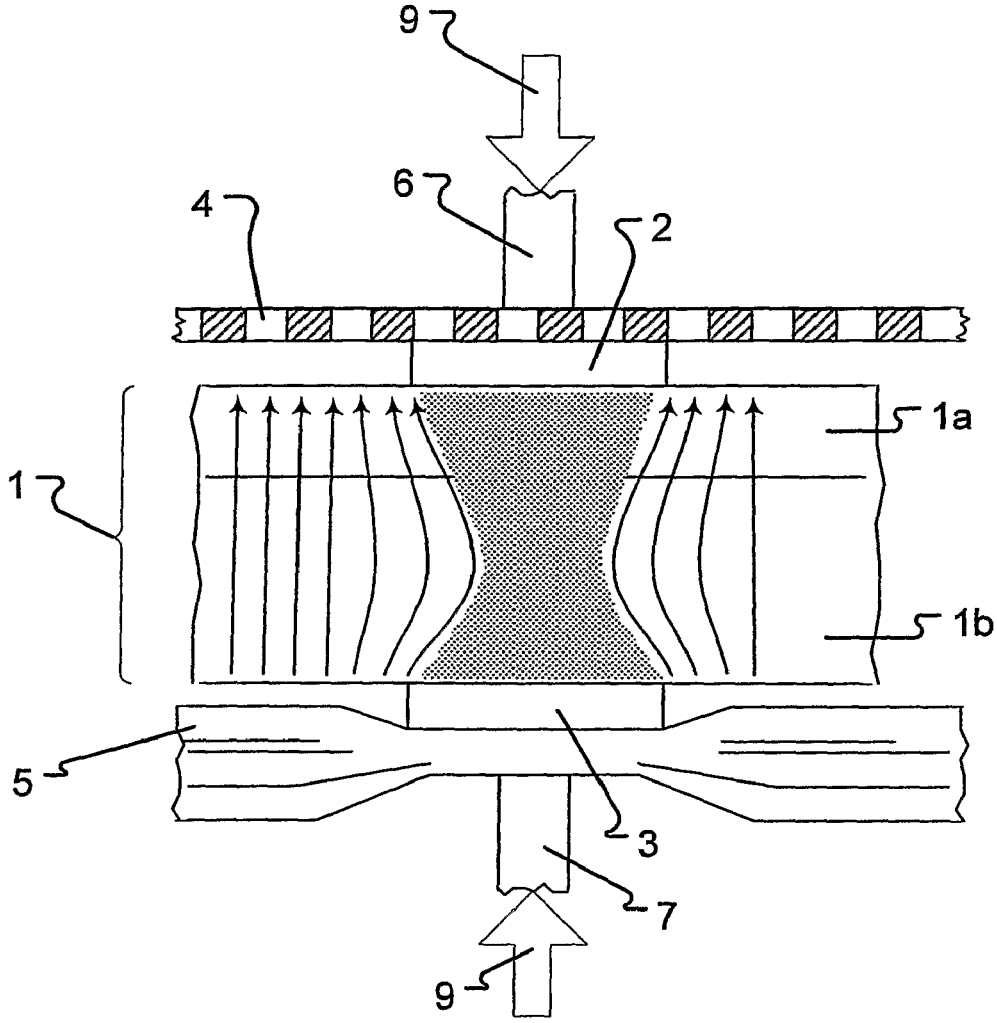
Figure 2B:
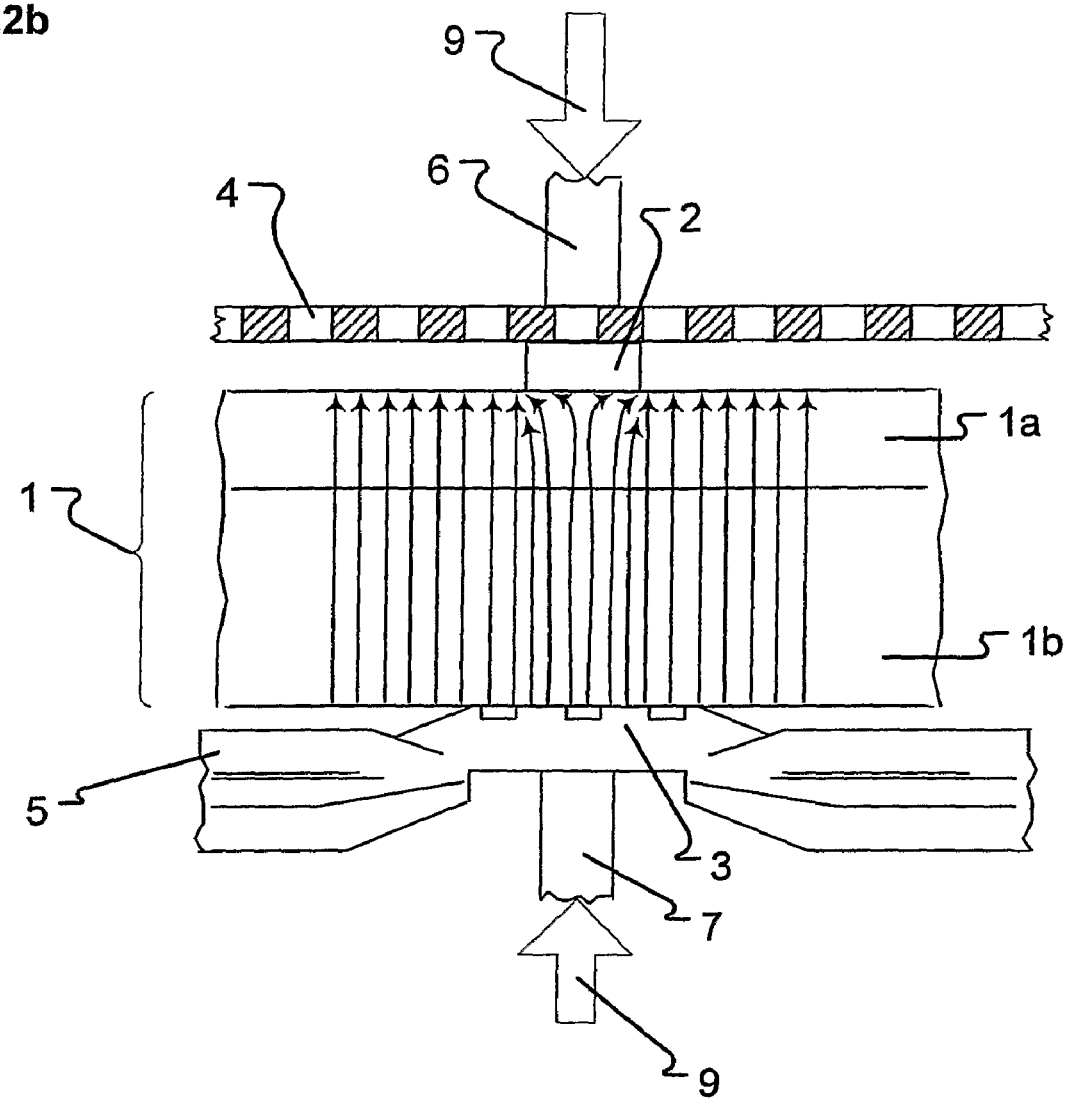
Figure 3:
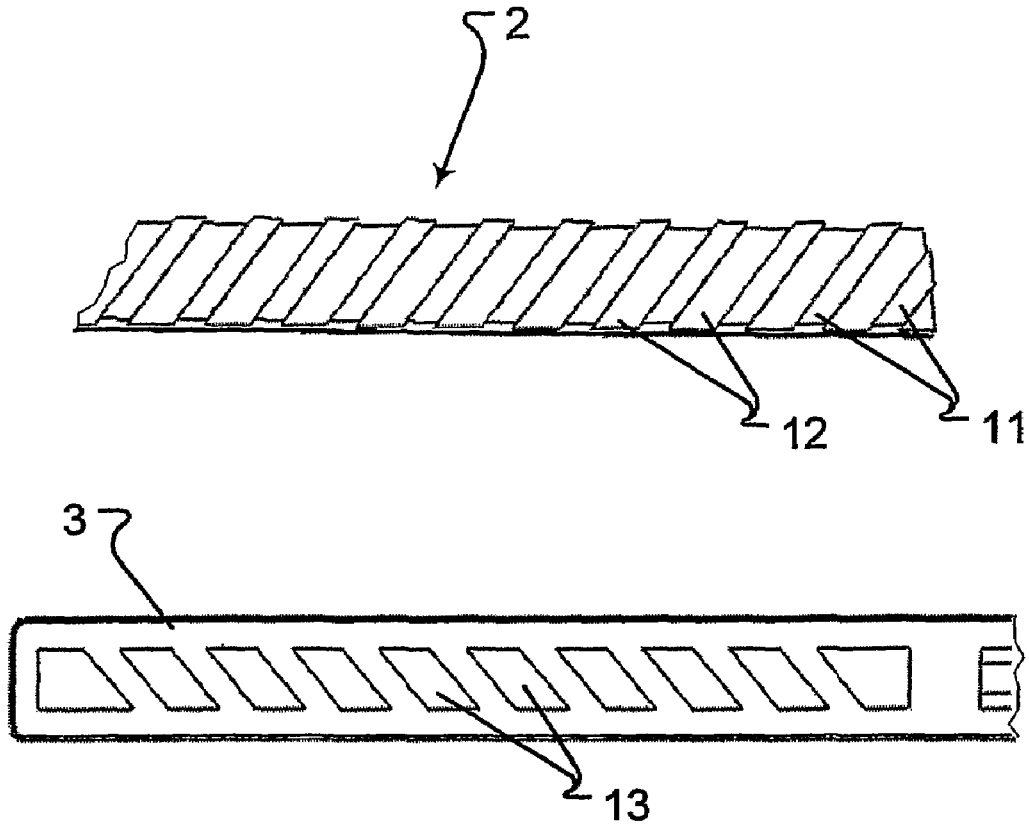

The invention is described hereinafter with the aid of the attached drawings which are provided by way of example and shall not be intended as a limitation of the scope thereof, wherein FIG. 1 is a perspective view of the electrolytic cell of the invention, FIG. 2*a* shows the distribution of the clamping force in a cell of the prior art, FIG. 2*b* shows the distribution of the current lines in a preferred embodiment of the cell of the invention, FIG. 3 shows the spacer elements according to one embodiment of the invention.

FIG. 1 shows the internal components in a perspective view of the electrolytic cell of the invention. Membrane 1 is clamped between spacers 2 and 3 which are in direct contact therewith. Anode 4 is pressed against spacer element 2, whose rear side is welded to strip 6. This strip is welded in its turn to the semi-shell wall 8. On the semi-shell wall 8, contact strip 10 is positioned along the height of strip 6 which in this case is shaped as a groove and accommodates the contact strips of the adjacent cell (not shown in the figure).

The construction of the cathode side is analogous so that cathode 5 is in direct contact with spacer element 3 which is welded to strip 7 on the rear side. Spacer element 3 is provided with openings as represented in detail in FIG. 3. The strip 7 is welded in its turn to the semi-shell wall 8.

FIG. 2*a* illustrates a section of a cell of the prior art, wherein the membrane thickness is exaggerated to facilitate the illustration thereof. The two arrows 9 indicate the direction of the external compressive force transmitted through the adjacent cells.

Membrane 1 has a high-resistance zone 1*a* on the cathode side and a low-resistance zone 1*b* on the anode side, in correspondence of the electric current admission. This membrane stratification helps for the uniform current distribution within the membrane. On account of the membrane being shielded by insulating spacer elements 2 and 3, as shown in FIG. 2*a*, the current flow lines are substantially diverted in the vicinity thereof, and sections of the membrane not crossed by the electric current flow are formed in the surrounding area. This section is identified by a dotted region. Due to these inactive sections, the voltage drop within the membrane and the current density in the active sections are increased.

FIG. 2*b* shows the pattern of the current lines in the membrane relative to an embodiment of the electrolytic cell of the invention. Spacer element 2 on the anode side is made of metal forms an integral piece with the anode, so that the current lines can enter the low-resistance zone 1*b* of membrane 1 in parallel without being deflected. This parallelism is maintained right through the high-resistance zone 1*a* within the area of spacer element 3 on the cathode side, so that no formation of blind areas not crossed by current lines takes place.

FIG. 3 illustrates the structure of a preferred embodiment of the spacer elements. The bar-type spacer piece 2 on the anode side has a profiled surface on the side in contact with the membrane, which in the illustrated example has rhombic protrusions 11 and depressions 12. Spacer piece 3 consisting of insulating material on the cathode side is provided with a multiplicity of superficial recesses so that upon installation spacer elements 2 and 3 do not cover any membrane surface area having a diameter above 5 mm.

The current density of the spacer elements of the invention was investigated in a test cell. In an electrolytic cell, seventeen rows of four spacers each having a 8 mm width and 295 mm length are installed. These spacer elements were provided with openings as shown in FIG. 3 so as to obtain a diameter of max. 5 mm for the contact surface. The recesses determined an overall open ratio of the spacer element surface, defined as the ratio of open to total surface, of about 50%.

In this way an increase in the active membrane surface of about 0.08 $m^2$ (from 2.72 $m^2$ to 2.80 $m^2$) was obtained. Hence, the current density decreased by 2.9%.

In this way, the operating voltage of the electrolytic cell equipped with a standard high load N982 membrane, showing a k factor of 80 mV/(kA$Nm^2$), is decreased by 2.3 mV/(kA/$m^2$) which leads to a voltage reduction of 14 mV at a current density of 6 kA/$m^2$. This corresponds to an energy saving of 10 kWh per tonne of product NaOH.

If the spacer is designed so as to exploit the complete membrane surface area, the voltage reduction doubles to 28 mV, corresponding to a 20 kWh saving per tonne of product NaOH.

The invention claimed is:

1. An electrolytic cell delimited by two semi-shells, each fixed to an electrode by means of a multiplicity of conductive strips, the electrodes consisting of an anode and a cathode having a major surface separated by a membrane, the membrane and the anode having a first multiplicity of spacer elements arranged therebetween, the membrane and the cathode having a second multiplicity of spacer elements arranged therebetween arranged in opposed pairs with said first multiplicity of spacer elements, said opposed pairs defining a contact area on the membrane surface and fixing the membrane in position, wherein at least one of said first and second multiplicity of spacer elements are made of an electrically conductive and corrosion-resistant material.

2. The electrolytic cell of claim 1 wherein said multiplicity of spacer elements made of an electrically conductive and corrosion-resistant material are said first multiplicity of spacer elements.

3. The electrolytic cell of claim 1 wherein at least one of the electrodes forms an integral piece with said multiplicity of spacer elements in the area contacting the membrane.

4. The electrolytic cell of claim 1 wherein said electrically conductive and corrosion-resistant material is selected from the group consisting of titanium and alloys thereof, nickel and alloys thereof, titanium-coated and nickel-coated materials.

5. The electrolytic cell of claim 1 wherein one of said first and second multiplicity of spacer elements consists of a multiplicity of electrically insulating spacer elements having a diameter not higher than 5 mm.

6. The electrolytic cell of claim 1 wherein the membrane thickness is increased by at least 10% in correspondence of the contact area with said multiplicity of spacer elements made of an electrically conductive and corrosion-resistant material.

7. The electrolytic cell of claim 6 wherein said increase in the membrane thickness is obtained by applying an additional coating on one side of the membrane.

8. The electrolytic cell of claim 7 wherein said additional coating is applied on the anode side of the membrane.

9. The electrolytic cell of claim 1 wherein both the first and second multiplicity of spacer elements are metallic and electrically conductive and the membrane thickness is increased by at least 10% in correspondence of the contact area defined by said opposed pairs of spacer elements.

10. The electrolytic cell of claim 6 wherein said membrane thickness is increased to a final thickness not exceeding the double of the original thickness.

11. The electrolytic cell of claim 1 wherein both the first and second multiplicity of spacer elements are metallic and electrically conductive, at least one of the first and second multiplicity of spacer elements being coated with the same material of the membrane or with a material of equivalent properties.

* * * * *